US010458403B2

(12) United States Patent
Chen et al.

(10) Patent No.: US 10,458,403 B2
(45) Date of Patent: Oct. 29, 2019

(54) SERVO PUMP CONTROL SYSTEM AND METHOD

(71) Applicant: EATON CORPORATION, Cleveland, OH (US)

(72) Inventors: Yilun Chen, Shanghai (CN); Xiaomeng Cheng, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 185 days.

(21) Appl. No.: 14/900,044

(22) PCT Filed: Jun. 27, 2014

(86) PCT No.: PCT/CN2014/080980
§ 371 (c)(1),
(2) Date: Dec. 18, 2015

(87) PCT Pub. No.: WO2014/206342
PCT Pub. Date: Dec. 31, 2014

(65) Prior Publication Data

US 2017/0268499 A1 Sep. 21, 2017

(30) Foreign Application Priority Data

Jun. 28, 2013 (CN) ..... 2013 1 0267723

(51) Int. Cl.
*F04B 49/06* (2006.01)
*F04B 19/22* (2006.01)
(Continued)

(52) U.S. Cl.
CPC ..... *F04B 49/06* (2013.01); *F04B 17/03* (2013.01); *F04B 19/22* (2013.01); *F04B 49/065* (2013.01); *F04B 51/00* (2013.01)

(58) Field of Classification Search
CPC ..... F04B 17/03; F04B 19/22; F04B 49/06; F04B 51/00
(Continued)

(56) References Cited

U.S. PATENT DOCUMENTS 3,911,677 A * 10/1975 Collins ..... B29C 45/76 60/368
2005/0084387 A1 4/2005 Klocke
(Continued)

FOREIGN PATENT DOCUMENTS

CN 1175664 A 3/1998
CN 1188371 A 7/1998
(Continued)

OTHER PUBLICATIONS

Extended European Search Report for corresponding European Patent Application No. 14818733.9 dated Feb. 6, 2017, 7 pgs.
(Continued)

*Primary Examiner* — Dominick L Plakkoottam
*Assistant Examiner* — Connor J Tremarche
(74) *Attorney, Agent, or Firm* — Merchant & Gould P.C.

(57) ABSTRACT

A servo pump control system (100) and a corresponding servo pump control method are disclosed. The servo pump control system (100) comprises a pressure controller (101) configured to receive a first control signal, and directly or indirectly provide a second control signal to the electric motor; and the pressure controller (101) configured to automatically commission at least one parameter without any manual adjustment.

12 Claims, 3 Drawing Sheets

(51) Int. Cl.
*F04B 51/00* (2006.01)
*F04B 17/03* (2006.01)

(58) Field of Classification Search
USPC ..... 417/440
See application file for complete search history.

(56) References Cited

U.S. PATENT DOCUMENTS

| | | | | |
|---|---|---|---|---|
| 2010/0126162 | A1* | 5/2010 | Hsu | F04B 49/20 60/431 |
| 2011/0165010 | A1* | 7/2011 | Iijima | F01C 21/0863 418/269 |
| 2013/0032961 | A1* | 2/2013 | Ueda | B29C 45/76 264/40.7 |

FOREIGN PATENT DOCUMENTS

| | | | |
|---|---|---|---|
| CN | 101349893 | A | 1/2009 |
| CN | 102001167 | A | 4/2011 |
| CN | 201792464 | U | 4/2011 |
| CN | 102195557 | A | 9/2011 |
| CN | 202062695 | U | 12/2011 |
| CN | 102734277 | A | 10/2012 |
| CN | 202742592 | U | 2/2013 |
| CN | 202805719 | U | 3/2013 |
| EP | 0 810 370 | A2 | 12/1997 |
| WO | WO 2013/070762 | A1 | 5/2013 |

OTHER PUBLICATIONS

International Search Report for corresponding International Patent Application No. PCT/CN2014/080980 dated Sep. 24, 2014.

* cited by examiner

SERVO PUMP CONTROL SYSTEM AND METHOD

This application is a National Stage Application of PCT/CN2014/080980, filed 27 Jun. 2014, which claims benefit of Serial No. 201310267723.3, filed 28 Jun. 2013 in China and which applications are incorporated herein by reference. To the extent appropriate, a claim of priority is made to each of the above disclosed applications.

FIELD OF THE INVENTION

This invention relates to servo pump control, particularly to a servo pump control system and method.

BACKGROUND OF THE INVENTION

In current servo pump systems, some problems and system limitations exist due to poor controller design coming from lack of thorough understanding of both the hydraulic and electric motor end of the whole electro-hydraulic system. Key limitations include: there is no auto-commissioning function available for the whole servo pump system; therefore, a try-and-error method needs to be used to manually adjust control parameters continuously, which is a very time-consuming process, increasing labor costs and downtime costs, and meanwhile, it is usually difficult to obtain a good control performance.

Therefore, a solution of servo pump control that can overcome the defects above is needed in the field.

SUMMARY OF THE INVENTION

In one aspect of the present invention, there is provided a servo pump control system, comprising: a pressure controller configured to receive a first control signal, and directly or indirectly provide a second control signal to the electric motor; and the pressure controller further configured to automatically commission at least one parameter without any manual adjustment.

In another aspect of the present invention, there is provided a servo pump control method, comprising: receiving a first control signal and directly or indirectly providing a second control signal to the electric motor by a pressure controller; and automatically commissioning at least one parameter by the pressure controller without any manual adjustment.

The servo pump control system and method according to embodiments of the present invention are capable of automatically commissioning parameters of the pressure controller without any manual adjustment, thus saving time, labor costs and downtime costs.

DETAILED DESCRIPTION OF EXEMPLARY EMBODIMENTS

Embodiments of the present invention are described below by referring to the figures. Numerous details are described below so that those skilled in the art can comprehensively understand and realize the present invention. However, it is apparent to those skilled in the art that the realization of the present invention may not include some of the details. In addition, it should be understood that the present invention is not limited to the described specific embodiments. On the contrary, it is contemplated that the present invention can be realized using any combination of the features and elements described below, no matter whether the features and elements relate to different embodiments or not. Therefore, the following aspects, features, embodiments and advantages are only for illustration, and should not be taken as elements of or limitations to the claims, unless explicitly stated otherwise in the claims.

Figure 1:
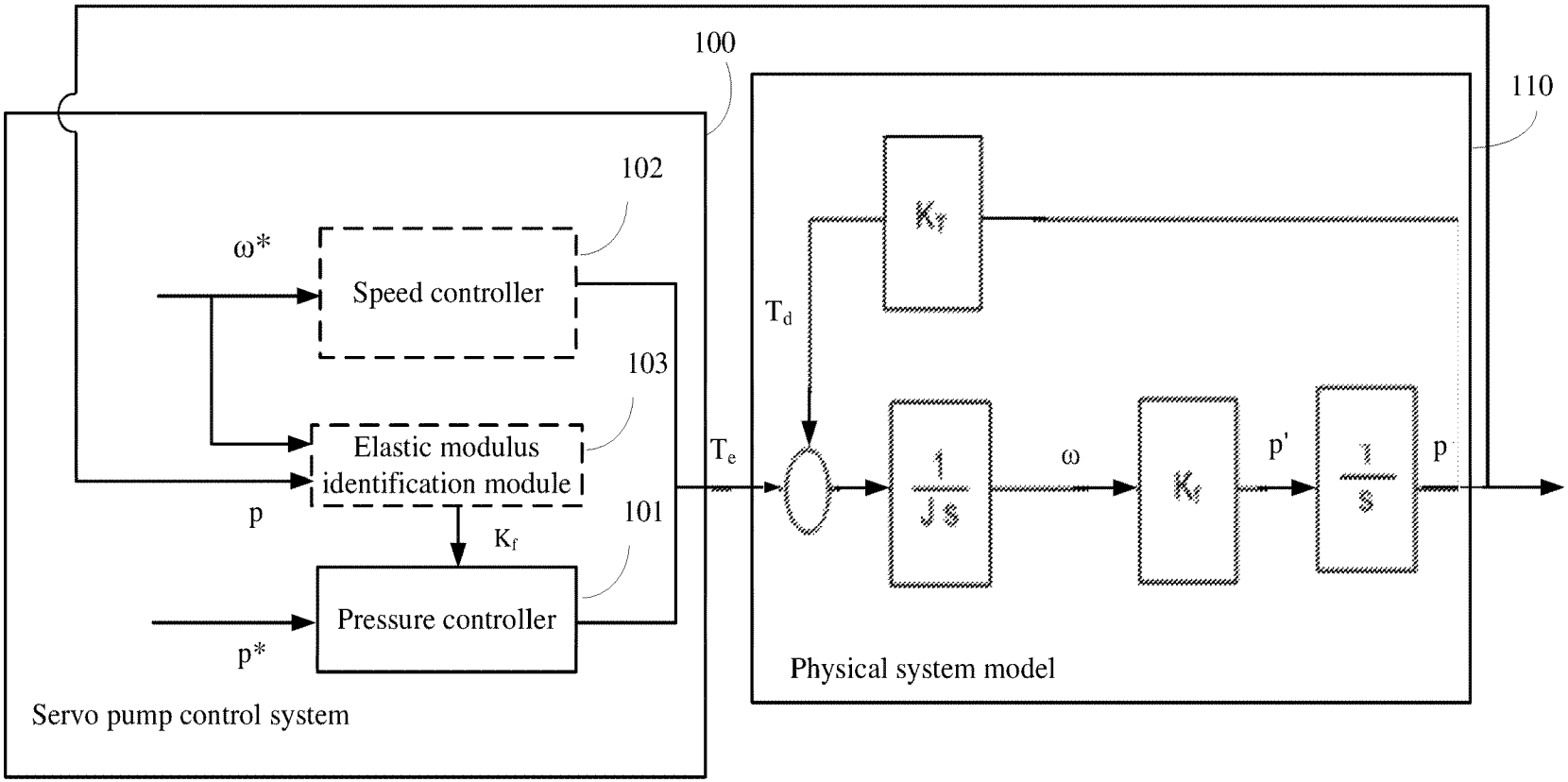
FIG. 1 illustrates a servo pump control system according to an embodiment of the present invention.

Now referring to FIG. 1, it illustrates a servo pump control system 100 according to an embodiment of the present invention. The servo pump control system 100 is for controlling a physical system including an electric motor, a pump and a load.

The dotted box of FIG. 1 shows a physical system model 110. As shown in the figure, the physical system model 110 can be simplified as a double integration system, having a feedback of physical states from the output pressure to the load torque. Specifically, a torque $T_e$ from the control system is divided by the inertia J of the electric motor and then is converted into the rotation speed ω of the electric motor via an integration 1/s; the rotation speed ω is multiplied by the elastic modulus $K_f$ of the pump and load, to be converted into a derivative p' of the output pressure of the pump; the derivative p' is converted into the output pressure p of the pump via an integration 1/s; the product $T_d$ of the output pressure multiplied by a parameter $K_T$, acting as a disturbance to the torque, is fed back to the input end of the physical system.

Referring to FIG. 1, the servo pump control system 100 according to an embodiment of the present invention comprises a pressure controller 101 configured to receive a first control signal, and directly or indirectly provide a second control signal to the electric motor; and the pressure controller 101 further configured to automatically commission at least one parameter without any manual adjustment.

The first control signal may be a pressure command signal P* set by a user, and the second control signal may be a torque control signal $T_e$. The pressure controller 101 may further comprise a torque controller (not shown) to provide a torque control signal to the electric motor. Of course, the torque controller may also be considered outside the pressure controller. The design of the torque controller depends only on the electric motor model, so it may be an existing torque controller, and its parameters may be determined at the production time and do not need to be adjusted during the system operation.

The pressure controller 101 may be any appropriate type of controllers known in the art, such as, a PID controller. However, different from an existing pressure controller, at least one parameter of the pressure controller 101 according to an embodiment of the present invention is automatically commissioned without any manual adjustment, which thus saving time, labor costs etc.

According to an embodiment of the present invention, the automatically commissioning at least one parameter comprises automatically commissioning at least one parameter of the pressure controller 101 based on a received elastic modulus $K_f$ of the physical model, for example, automatically commissioning a parameter of a PIC controller included in the pressure controller 101 based on a received elastic modulus $K_f$ of the physical model. The elastic modulus $K_f$ reflects dynamic physical properties of the hydraulic system, thus, commissioning a parameter(s) of the pressure controller 101 based on the elastic modulus $K_f$ can make the pressure controller 101 better adapt to a specific hydraulic system and hydraulic application and maintain a good control performance under varying system operation conditions.

Only as an example, the pressure controller 101 may include a PID controller and a torque controller, and the output of the PID controller after being divided by the elastic modulus $K_f$, is provided to the torque controller as its input. Furthermore, only as an example, the output pressure of the pump from a pressure sensor after being multiplied by the parameter $K_T$ is also provided to the torque controller as part of its input. In addition, the output pressure of the pump from the pressure sensor may also be provided to the PID controller as part of its input. It should be pointed out that the description above is only exemplary, rather than limitations to the present invention. The pressure controller 101 may commission its parameters with the elastic modulus $K_f$ in various other ways, provided only that the use of the elastic modulus $K_f$ can make the operation of the controller 101 well reflect the dynamic physical properties of the physical system.

According to an embodiment of the present invention, the elastic modulus $K_f$, is automatically identified by the system. To this end, the servo pump control system 100 further comprises the following optional modules: a speed controller 102 configured to receive a constant speed command, and directly or indirectly provide a third control signal to the electric motor so that the electric motor rotates with a constant speed; and an elastic modulus identification module 103 configured to identify the elastic modulus based on the rotation speed of the electric motor and the output pressure of the pump.

The speed controller 102 may be any existing or newly developed speed controller, which can make the electric motor rotate with a constant speed after receiving a constant speed command. Furthermore, design of the speed controller 102 depends only on the electric motor model, so its parameters may be determined at the production time of the system and do not need to be adjusted during the system operation. The elastic modulus identification module 103 is capable of identifying the elastic modulus $K_f$ based on the rotation speed of the electric motor under control of the speed controller 102 and the output pressure of the pump. The rotation speed of the electric motor may come from a speed sensor installed at the electric motor or directly come from a speed command. The output pressure of the pump may come from a pressure sensor installed at the output end of the pump.

Figure 2:
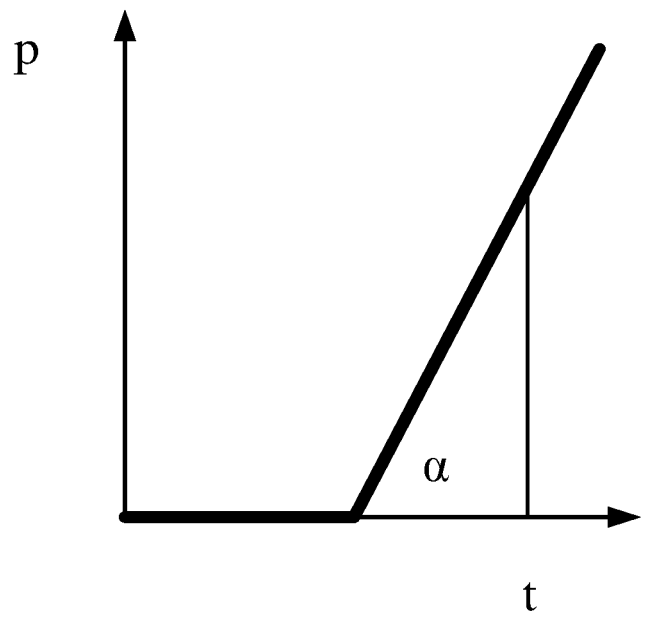
FIG. 2 illustrates a graph of the output pressure of the pump varying with time.

After the speed controller 102 receives a constant speed command ω, the pump is driven by the electric motor to rotate with a constant speed, and the output pressure of the pump remains constant (working state I) at the beginning of each working cycle of the hydraulic cylinder until the hydraulic cylinder comes to the end. At this time, the constant speed control continues to be applied and the output pressure of the pump will rise linearly with the position of the cylinder (working state II). The working state II is a state when the liquid in the hydraulic cylinder is pressed to the end by the piston and the gap in the hydraulic cylinder disappear so that the pressure starts to rise linearly with the position of the piston, and this state may also be called a stable working state. FIG. 2 illustrates a graph of the output pressure of the pump varying with time. According to an embodiment of the present invention, the elastic modulus identification module 103 identifies the elastic modulus $K_f$ as a ratio of the slope of the rising pressure to the rotation speed of the electric motor, i.e., the ratio of the first derivative of the output pressure of the pump (i.e. the tangent of α in FIG. 2) to the rotation speed of the electric motor, as shown in the following equation:

$$K_f = \frac{p'}{\omega},$$

wherein p' is the first derivative of the output pressure of the pump, and ω is the rotation speed of the electric motor (coming from a rotation speed command or a speed sensor).

In addition, the parameter $K_T$ may also be identified as a ratio of a torque command received by the physical system to the output pressure of the pump, as shown in the following equation:

$$K_T = \frac{T_e}{P},$$

wherein $T_e$ is a torque command received by the physical system from the control system, and P is the output pressure of the pump. Thus, during each working cycle of the cylinder cycle, the two hydraulic parameters in the physical model may be automatically identified, and the controller parameters may be automatically commissioned based on the identified hydraulic parameters. The identification method is steady for parameter changes during operation such that the control system better adapts to dynamic variations of the hydraulic system.

The servo pump control system according to an embodiment of the present invention is described above by referring to the figures. It should be pointed out that the description above is only exemplary, not limitation to the present invention. In other embodiments of the present invention, the system may have more, less or different modules, and the including, connecting and functional relations among these modules may be different from that described and illustrated.

In another aspect of the present invention, there is further provided a servo pump control method. The method may be performed by the servo pump control system described above. To be concise, some contents repetitive with the above description are omitted from the following description. Therefore, the above description may be referred to in order to know about the method in more detail.

Figure 3:
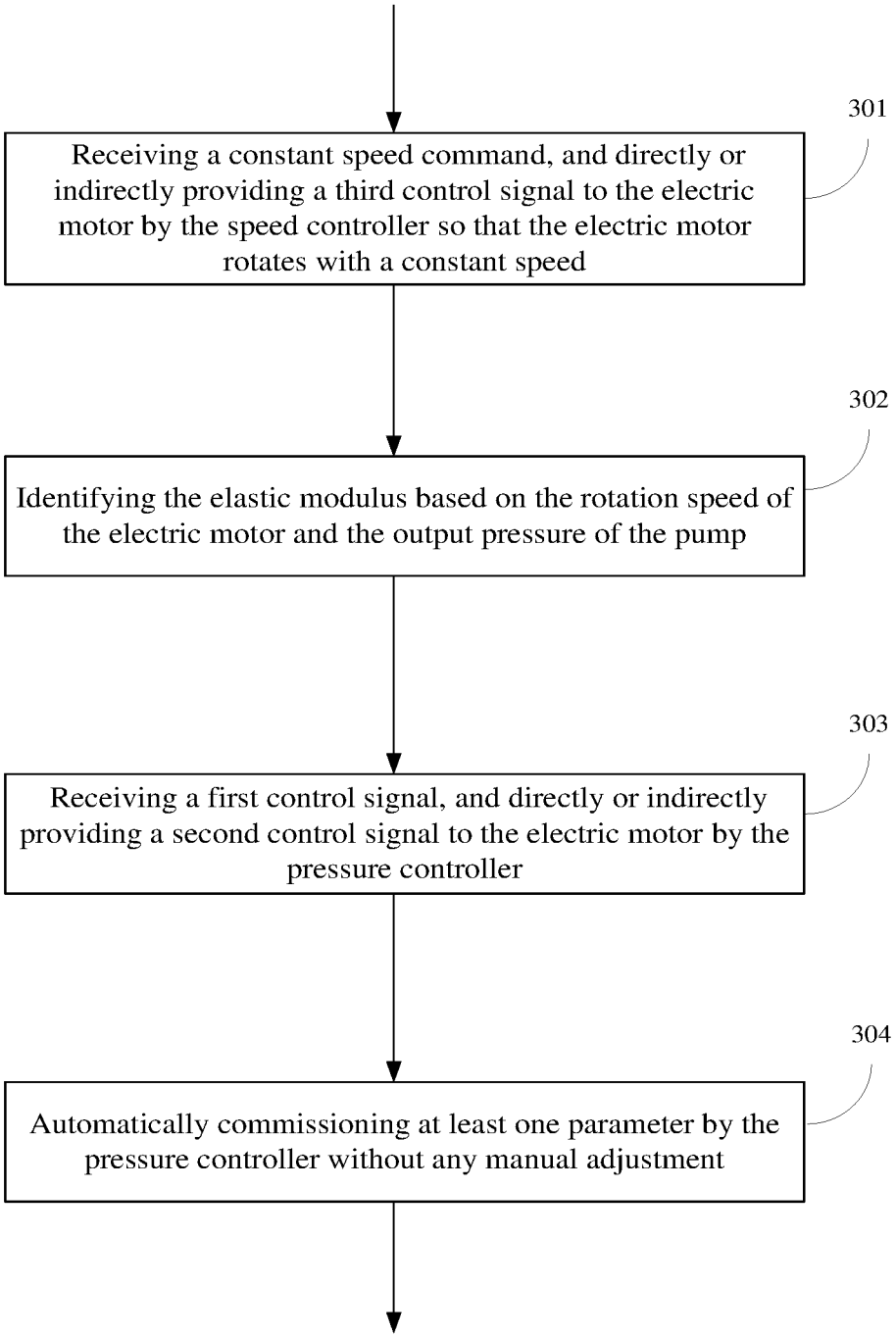
FIG. 3 illustrates a servo pump control method according to an embodiment of the present invention.

FIG. 3 illustrates a servo pump control method according to an embodiment of the present invention. As shown by the figure, the method comprises the following steps:

step 303, receiving a first control signal and directly or indirectly providing a second control signal to the electric motor by a pressure controller; and at step 304, automatically commissioning at least one parameter by the pressure controller without any manual adjustment.

According to an embodiment of the present invention, the automatically commissioning at least one parameter comprises automatically commissioning at least one parameter based on a received elastic modulus of the physical model.

According to an embodiment of the present invention, the method further comprises the following steps:

at step 301, receiving a constant speed command and directly or indirectly providing a third control signal to the electric motor by a speed controller so that the electric motor rotates with a constant speed; and at step 302, identifying the elastic modulus based on the rotation speed of the electric motor and the output pressure of the pump.

According to an embodiment of the present invention, the identifying the elastic modulus comprises calculating the elastic modulus according to the following equation:

$$K_f = \frac{p'}{\omega},$$

wherein p' is the first derivative of the output pressure of the pump, and ω is the rotation speed of the electric motor.

According to an embodiment of the present invention, the rotation speed of the electric motor comes from a speed sensor or a speed command, and the output pressure of the pump comes from a pressure sensor.

According to an embodiment of the present invention, the rotation speed of the electric motor and the output pressure of the pump are respectively the rotation speed of the electric motor and the output pressure of the pump when the pump works in a stable condition, in which the first derivative of the output pressure of the pump has a linear relation with the rotation speed of the electric motor.

According to an embodiment of the present invention, the automatically commissioning at least one parameter based on a received elastic modulus of the physical model comprises automatically commissioning the parameters of a PID controller based on a received elastic modulus of the physical model.

The servo pump control method according to embodiments of the present invention is described above by referring to the figures. It should be pointed out that the description above is only exemplary, not limitation to the present invention. In other embodiments of the present invention, the method may have more, less or different steps, and the including, sequential and functional relations among these steps may be different from that described and illustrated in the present invention.

While exemplary embodiments of the present invention are described above, the present invention is not limited to this. Those skilled in the art may make various changes and modifications without departing from the spirit and scope of the present invention. For example, it is contemplated that the technical solution of the present invention is also applicable to other fluid pumps apart from hydraulic pumps. The scope of the present invention is only defined by the claims.

The invention claimed is:

1. A servo pump control system for a physical model including an electric motor and a hydraulic pump connected to a load and actuated by the electric motor, the system comprising: a pressure sensor installed at an output of the hydraulic pump and detecting an output pressure of the hydraulic pump; a pressure controller for commissioning a plurality of parameters including: a PID controller receiving the output pressure of the hydraulic pump and generating a first parameter; and a torque controller receiving a second parameter and a third parameter; the pressure controller configured to receive a first control signal, the first control signal including a pressure command signal set by a user; and directly or indirectly provide a second control signal to the electric motor to control the electric motor, the second control signal including a torque control signal generated by the torque controller; and the pressure controller further configured to automatically commission the plurality of parameters without any manual adjustment, based at least in part on an elastic modulus of the physical model calculated as a ratio of a first derivative of the output pressure of the hydraulic pump to a rotation speed of the electric motor, the the plurality of parameters being automatically commissioned by: receiving the output pressure of the hydraulic pump and generating the first parameter as an output of the PID controller calculating the second parameter by dividing the output of the PID controller by the elastic modulus; obtaining the third parameter by multiplying the output pressure of the hydraulic pump by a ratio of a torque command received by the physical model to the output pressure of the pump; and generating the torque control signal based at least in part on the second parameter and the third parameter received by torque controller.

2. The servo pump control system according to claim 1, further comprising:

a speed controller configured to receive a constant speed command, and directly or indirectly provide a third control signal to the electric motor so that the electric motor rotates with a constant speed; and an elastic modulus identification module configured to identify the elastic modulus based on the rotation speed of the electric motor and the output pressure of the pump.

3. The servo pump control system according to claim 2, wherein the rotation speed of the electric motor comes from a speed sensor or a speed command, and the output pressure of the pump comes from a pressure sensor.

4. The servo pump control system according to claim 2, wherein the rotation speed of the electric motor and the output pressure of the pump are respectively the rotation speed of the electric motor and the output pressure of the pump when the pump works in a stable condition, in which the first derivative of the output pressure of the pump has a linear relation with the rotation speed of the electric motor.

5. The servo pump control system according to claim 1, wherein the automatically commissioning the plurality of parameters based on the elastic modulus of the physical model comprises automatically commissioning parameters of a PID controller based on the elastic modulus of the physical model.

6. A servo pump control method for a physical model including an electric motor and a hydraulic pump connected to a load and actuated by the electric motor, the method comprising: receiving a first control signal, the first control signal including a pressure command signal set by a user; directly or indirectly providing a second control signal to the electric motor by a pressure controller, the second control signal including a torque control signal; and automatically commissioning a plurality of parameters by the pressure controller without any manual adjustment, based at least in part on an elastic modulus of the physical model calculated as a ratio of a first derivative of an output pressure of the hydraulic pump to a rotation speed of the electric motor, the plurality of parameters being automatically commissioned by: receiving the output pressure of the hydraulic pump and generating a first parameter as an output of the pressure controller; calculating a second parameter by dividing the output of the pressure controller by the elastic modulus; obtaining a third parameter by multiplying the output pressure of the hydraulic pump by a ratio of a torque command received by the physical model to the output pressure of the pump; and generating the torque control signal based at least in part on the second parameter and the third parameter.

7. The servo pump control method according to claim 6, further comprising:

receiving a constant speed command and directly or indirectly providing a third control signal to the electric motor by a speed controller so that the electric motor rotates with a constant speed; and identifying the elastic modulus based on the rotation speed of the electric motor and the output pressure of the pump.

8. The servo pump control method according to claim 7, wherein the rotation speed of the electric motor comes from a speed sensor or a speed command, and the output pressure of the pump comes from a pressure sensor.

9. The servo pump control method according to claim 7, wherein the rotation speed of the electric motor and the output pressure of the pump are respectively the rotation speed of the electric motor and the output pressure of the pump when the pump works in a stable condition, in which the first derivative of the output pressure of the pump has a linear relation with the rotation speed of the electric motor.

10. The servo pump control method according to claim 6, wherein the automatically commissioning the plurality of parameters based on the elastic modulus of the physical model comprises automatically commissioning parameters of a PID controller based on the elastic modulus of the physical model.

11. A servo pump control system comprising: an electric motor; a hydraulic pump actuated by the electric motor; a hydraulic actuator operated by the hydraulic pump, the hydraulic actuator connected to a load and actuating the load; and a pressure controller configured to provide a torque control signal to the electric motor to control the electric motor, the pressure controller further configured to automatically commission a plurality of parameters without any manual adjustment, based at least in part on an elastic modulus of a physical model, the physical model including at least the electric motor and the hydraulic pump, the elastic modulus calculated based on a rotation speed of the electric motor and an output pressure of a hydraulic fluid from the hydraulic pump, and the pressure controller further configured to: receive the output pressure of the hydraulic fluid from the hydraulic pump and generate a first parameter as an output of the pressure controller; calculate a second parameter by dividing the output of the pressure controller by the elastic modulus; obtain a third parameter by multiplying the output pressure of the hydraulic fluid from the hydraulic pump by a ratio of a torque command received by the physical model to the output pressure of the pump; and generate the torque control signal based at least in part on the second parameter and the third parameter.

12. The servo pump control system of claim 11, wherein the hydraulic actuator includes a hydraulic cylinder.

* * * * *